United States Patent [19]

Koehler

[11] 4,200,218

[45] Apr. 29, 1980

[54] METHOD OF ATTACHING FITTINGS TO A CYLINDRICAL WELL SCREEN

[75] Inventor: Raymond A. Koehler, Oak Grove, Minn.

[73] Assignee: UOP Inc., Des Plaines, Ill.

[21] Appl. No.: 952,502

[22] Filed: Oct. 18, 1978

[51] Int. Cl.[2] ..... B23K 31/02

[52] U.S. Cl. ..... 228/165; 29/163.5 CW; 228/178

[58] Field of Search ..... 29/163.5 R, 163.5 CW, 29/163.5 F; 228/165, 154, 178; 166/231-233

[56] References Cited

U.S. PATENT DOCUMENTS

| | | | |
|---|---|---|---|
| 1,293,871 | 2/1919 | Murray | 228/165 X |
| 1,729,197 | 9/1929 | Whann | 29/163.5 CW X |
| 1,878,432 | 9/1932 | Whann | 166/232 |

*Primary Examiner*—Francis S. Husar
*Assistant Examiner*—K. J. Ramsey
*Attorney, Agent, or Firm*—James R. Hoatson, Jr.; Barry L. Clark; William H. Page, II

[57] ABSTRACT

Improved method of attaching sleeve-like fittings to a wrapped wire well screen by welding is faster and stronger than prior methods, provides better mechanical sealing, and eliminates changes in the width of the screen slots. The fitting is axially slotted where it is intended to telescopically overlie several wraps of the well screen. The application of weld beads in the axially directed slots causes the fitting to shrink into tight mechanical contact with the well screen and prevents the enlargement of the slots in the well screen which is possible when a circumferentially oriented weld bead is applied.

3 Claims, 4 Drawing Figures

Figure 1 (Prior Art)
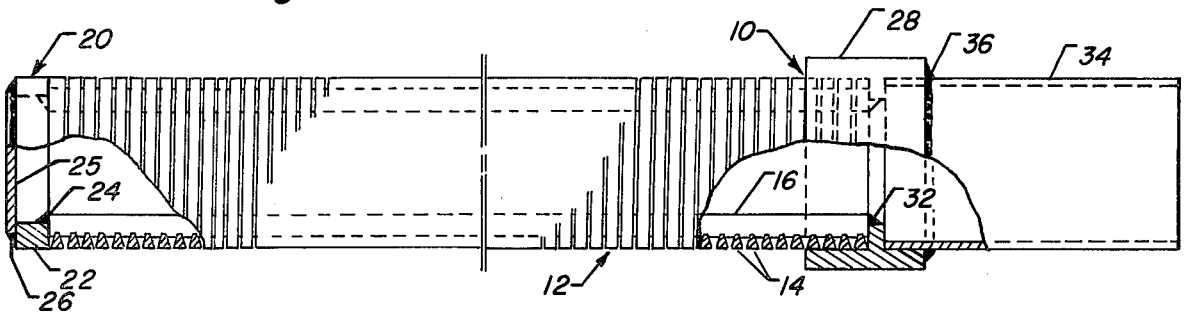
Figure 2 (Prior Art)
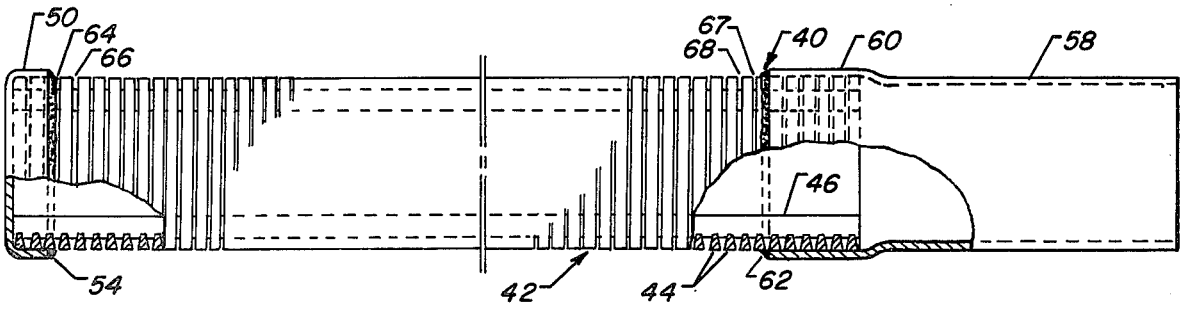
Figure 3
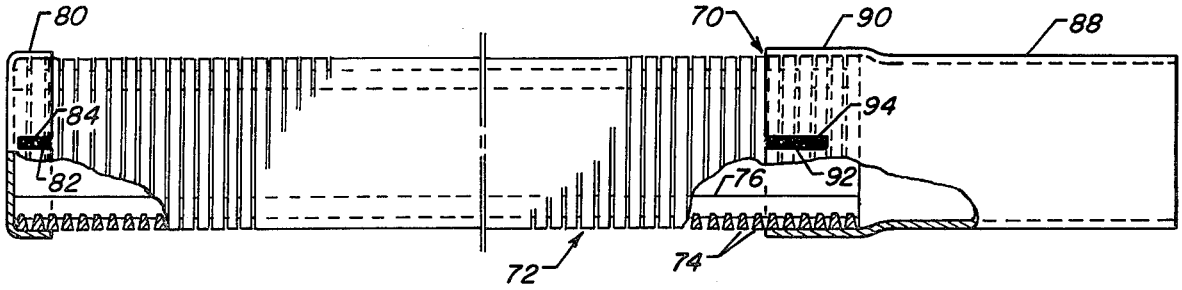
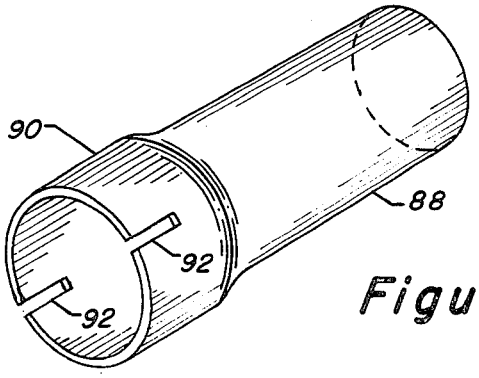
Figure 4

METHOD OF ATTACHING FITTINGS TO A CYLINDRICAL WELL SCREEN

BACKGROUND OF THE INVENTION

The invention relates to cylindrical well screens and particularly to the attachment of fittings thereto such as pipes, tubes and end plates. Typically, as disclosed in E. E. Johnson U.S. Pat. No. 2,046,461, well screens are made by helically wrapping a shaped wire around a plurality of longitudinal rods which are circumferentially spaced from each other. The wire wrap is welded to each of the rods which it crosses and the winding pitch is controlled so that a continuous slot of a constant width is formed by the wrapped wire. Since the well screens are typically formed in long lengths which are then cut to size, it is necessary to attach fittings to them to permit them to be joined to an adjacent pipe, for example, or to close off one end. One typical fitting might be a piece of pipe which has an internal diameter slightly larger than the outside diameter of the well screen. One end of the pipe may be telescoped over one end of the well screen and circumferentially welded thereto either internally or externally. Obviously, where a circumferential weld is made to the wire wrap the strength of the joint is dependent upon the strength of one wrap and its welded connection to the internal support rods. When a circumferential weld is made to one of the wraps of wire, the adjacent wrap of wire will tend to pull toward the weld as the joint cools and will thereby cause the slot opening in the screen between the first adjacent wrap and the second adjacent wrap to widen and thus render the screen less effective for its purpose. A third disadvantage of a circumferential weld is that it takes a substantial amount of time to perform the weld and thus is quite costly. The time required for the weld can be especially great when the welder is taking great care to minimize the tendency to "pull" by carefully regulating heat input and rate of welding.

SUMMARY OF THE INVENTION

It is among the objects of the present invention to provide an improved method of attaching sleeve-like fittings to a wrapped wire well screen which will be not only faster and stronger than prior methods but will provide a better sealing while preventing changes in the width of the slot in the screen which is defined by the wraps of wire. These and other objects and advantages are attained by the method of the present invention wherein slots are cut in the fitting in a direction parallel to the axis of the well screen and fitting and transverse to the wire wraps. The slots cut in the fittings are preferably of a length sufficient to transversely cross a plurality of wire wraps. The fitting, which has an internal diameter only slightly larger than the outer diameter of the well screen, is then welded to the well screen by applying weld beads in each of the slots. The weld beads not only improve the strength of the joint by being connected to several wire wraps instead of just one but the fitting has a tendency to shrink in internal diameter as the welds cool and pull the sides of the slots together, thus providing an interference fit and an enhanced mechanical seal between the elements. The short longitudinal welds in the slots of the fitting are also less critical to make than a circumferential weld since they are shorter and since potential widening of the screen slots is not a problem.

BRIEF DESCRIPTION OF THE DRAWINGS

FIG. 1 is a side view, partially in section, illustrating one prior art method of attaching a well screen to its fittings;

FIG. 2 is a side view, partially in section, illustrating a second prior art method of attaching a well screen to its fittings;

FIG. 3 is a side view illustrating my improved method for attaching fittings of the general configuration illustrated in FIG. 2; and FIG. 4 is a perspective view illustrating one of the fittings shown in FIG. 3.

DETAILED DESCRIPTION OF THE INVENTION

FIG. 1 is a partially sectioned side view illustrating one typical prior art assembly of a well screen to a pipe and an end cap. The assembly is indicated generally at 10 and includes a length of well screen 12 which is formed by wrapping and welding a continuous length of trapezoidal shaped wire 14 to a plurality of longitudinal rods 16. The lower end of the well screen is shown as being closed by an end cap 20 comprising a sleeve member 22 welded at 24 to the rods 16 and an end plate 25 which is welded to the sleeve 22 by a peripheral weld 26. The opposite or upper end of the well screen is welded to a sleeve-like connector member 28 which has an internal radial flange portion which is welded to the rods 16 by a weld 32. A pipe member 34 is telescoped internally of the connector member 28 and welded thereto by a peripheral weld bead 36.

Another typical type of prior art mounting arrangement is shown in FIG. 2 wherein a screen assembly 40 can be seen as comprising a well screen portion 42 formed of a continuous length of a wire wrap member 44 welded to longitudinal rod members 46. By using external welds for attachment to the well screen, the end cap 50 may be made in one piece rather than two as is necessary in the FIG. 1 embodiment. The end cap 50 is formed in a cup-shaped manner and is welded to the screen member 42 around its circumference by a weld bead 54. At the opposite end of the well screen a pipe member 58 having a flared end portion 60 is shown as being telescopically positioned over the well screen and welded circumferentially thereof by a weld bead 62. Although the use of external welds in this arrangement permits the end cap and the pipe to be of simple one piece construction, a shrinkage problem often arises when the long circumferential welds 54, 62 are applied to the wire wrap 44. As the weld metal cools, it shrinks and the immediately adjacent wrap 44 is pulled toward the weld. This pulling causes the gap 64 which is closest to the weld 54 to become smaller while the next adjacent gap 66 becomes larger. Similarly, the gaps 67, 68 adjacent the weld 62 will be smaller and larger respectively than the average gap. Obviously, having one gap larger than the remaining one is very undesirable since it allows the entry of larger particles through the screen than is desired.

FIG. 3 illustrates my improved method of attaching fittings to a cylindrical well screen. The assembly 70 is generally similar to the assembly 40 of FIG. 2 in that the screen section 72 includes a wire wrap portion 74 welded to longitudinal rod members 76. The end cap 80 is also similar to the end cap 50 but is provided with a pair of opposed slots 82 which extend in a longitudinal direction a sufficient distance to overlap at least two of the wire wraps 74. After the cap 80 is mounted on the end of screen 72, a weld bead 84 is applied in each of the slots 82 to anchor the cap to the screen. Since the weld bead 84 will shrink as it is cooled, it will pull the sides of the slots 82 toward each other. This pulling will decrease the internal diameter of the end cap 80 and cause the end cap to tightly engage the wire wraps 74. In a typical embodiment the internal diameter of the end cap 80 might be approximately 1.020–1.023" so as to provide a clearance over the end of the well screen 72 which might have an outer diameter of approximately 1.015". For ease of assembly, a clearance of at least about 0.005" is desirable but greater clearances can be tolerated depending upon the width of the slot and the diameter of the end cap. By providing a shrink fit relationship between the end cap 80 and the screen 72 after welding, the rigidity of the attachment is enhanced since a firm mechanical seal and bond is thus provided. However, if additional holding power is required, additional slots and weld beads may be provided. The connection of the screen 72 to the flared end 90 of pipe member 88 is generally identical to that previously discussed in connection with the end cap 80. For example, the slots 92 are made of sufficient length so as to extend in an axial direction across a plurality of wire wraps 74 to which the flared end 90 is mounted by means of the weld beads 94. Contact with four wraps of wire are illustrated but the number can vary in accordance with the degree of strength required.

Although my improved method of attachment of fittings to a weld screen have been shown in connection with only two types of fittings, it is obvious that the principle would apply to other types of fittings as well.

I claim:

1. A method of attaching a cylindrical fitting to one end of a cylindrical, wire wrapped well screen which has a plurality of closely spaced wrap wires affixed to a plurality of longitudinal internal rods, comprising the steps of forming the fitting so its internal diameter is only slightly greater than the outer diameter of the wrap wires; forming a plurality of axially extending slots in one end of said fitting; telescopically placing the slotted end portion of the fitting over a plurality of wrap wires on one end of the well screen; and welding said fitting to said last plurality of wrap wires by applying a weld bead along the length of each of said slots; said welding step serving to reduce the outside diameter of said fitting in the region of said slots to cause said fitting to shrink into tight mechanical contact with said end of said well screen.

2. The method of claim 1 wherein only two generally diametrically opposed slots are formed in said one end of said fitting.

3. The method of claim 1 wherein the fitting has an internal diameter of no more than about 0.008" greater than the outer diameter of the well screen portion which it overlies.

* * * * *